US011761595B1

(12) United States Patent
Parsons

(10) Patent No.: US 11,761,595 B1
(45) Date of Patent: Sep. 19, 2023

(54) NIGHTSTAND ARC LAMP/FLOOR LAMP

(71) Applicant: Pamela S. Parsons, Monkton, MD (US)

(72) Inventor: Pamela S. Parsons, Monkton, MD (US)

(73) Assignee: PTY LIGHTING, L.L.C., Cranford, NJ (US)

( * ) Notice: Subject to any disclaimer, the term of this patent is extended or adjusted under 35 U.S.C. 154(b) by 0 days.

(21) Appl. No.: 17/973,676

(22) Filed: Oct. 26, 2022

(51) Int. Cl.
*F21S 6/00* (2006.01)
*F21V 23/06* (2006.01)

(52) U.S. Cl.
CPC ..... *F21S 6/003* (2013.01); *F21V 23/06* (2013.01)

(58) Field of Classification Search
CPC .... F21S 6/00; F21S 6/005; F21S 6/003; F21S 6/004; F21V 23/06
See application file for complete search history.

(56) References Cited

U.S. PATENT DOCUMENTS 3,015,024 A * 12/1961 Charchan ..... A01G 9/12 174/45 R
4,217,629 A * 8/1980 Russell ..... F21S 8/037 362/147
5,265,000 A * 11/1993 Lin ..... F21V 21/14 362/450
5,567,043 A * 10/1996 Swanson ..... F21V 21/26 362/249.07

FOREIGN PATENT DOCUMENTS

CA 2979692 A1 * 3/2018 ..... F21S 6/002
JP 2001014938 A * 1/2001

* cited by examiner

*Primary Examiner* — Anabel Ton
(74) *Attorney, Agent, or Firm* — Walter J. Tencza, Jr.

(57) ABSTRACT

A lighting apparatus including a base; a backplate having a first end fixed to the base, so that the backplate is substantially perpendicular to the base; a first arm fixed to the backplate nearer a second end of the backplate which is opposite the first end of the backplate; a first light socket fixed to the first arm; an electrical socket fixed to the backplate between where the first arm is fixed to the backplate and where the first end of the backplate is fixed to the base; and a first electrical conductor running from the first light socket to the base. The lighting apparatus may further include a second arm fixed to the backplate nearer the second end of the backplate; a second light socket fixed to the second arm; and a second electrical conductor running from the second light socket to the base.

14 Claims, 28 Drawing Sheets

NIGHTSTAND ARC LAMP/FLOOR LAMP

FIELD OF THE INVENTION

This invention relates to lighting apparatuses and methods.

BACKGROUND OF THE INVENTION

There is a need for better lighting apparatuses. Currently the typical nightstand lamps take up a great deal of limited space on nightstands which diminishes the ability to use the nightstand for CPAP (Continuous positive airway) machines, books, glasses, phones or other uses. Alternatively, wall sconces above nightstands require installation of junction boxes in the wall and precise measurements to locate the boxes and install sconces. If the design changes, then moving a junction box requires an electrician and finishing contractor to complete the work.

SUMMARY OF THE INVENTION

One or more embodiments of the present invention provide a lighting apparatus which frees a nightstand surface substantially or completely compared to table style lamps. Compared to wall sconces, a lighting apparatus in accordance with one or more embodiments of the present invention eliminates the need for an electrician to install power in the wall at precise locations and a finisher from having to finish the junction box/wall. One or more embodiments of the present invention create the appearance of a wall sconce with the ease of a simple plug-in lamp and fits neatly behind a nightstand, with an offset for a floor base, and allows ease of installation and relocation at will.

In at least one embodiment, a lighting apparatus is provided which may include a base; a backplate having a first end fixed to the base, so that the backplate is substantially perpendicular to the base; a first arm fixed to the backplate nearer a second end of the backplate which is opposite the first end of the backplate; a first light socket fixed to the first arm; an electrical socket fixed to the backplate between where the first arm is fixed to the backplate and where the first end of the backplate is fixed to the base; and a first electrical conductor running from the first light socket to the base.

The lighting apparatus may further include a second arm fixed to the backplate nearer the second end of the backplate; a second light socket fixed to the second arm; and a second electrical conductor running from the second light socket to the base.

The lighting apparatus may further include a pedestal member fixed to the base; and wherein the first end of the backplate is fixed to the base through the pedestal member, so that the backplate is offset horizontally from the base.

The apparatus may further include a first attachment device configured to attach a first lamp shade to the first arm; and a second attachment device configured to attach a second lamp shade to the second arm, while the first lamp shade is attached to the first arm.

The apparatus may further include a first switch for turning electrical power on and off to the first light socket fixed to the electrical socket between where the first arm is fixed to the backplate and where the first end of the backplate is fixed to the base; and a second switch for turning electrical power on and off to the second light socket fixed to the electrical socket between where the second arm is fixed to the backplate and where the first end of the backplate is fixed to the base.

In at least one embodiment, a method is provided which may include fixing a first end of a backplate to a base, so that the backplate is substantially perpendicular to the base; fixing a first arm to the backplate nearer a second end of the backplate which is opposite the first end of the backplate; fixing first light socket to the first arm; fixing an electrical socket to the backplate between where the first arm is fixed to the backplate and where the first end of the backplate is fixed to the base; and running a first electrical conductor from the first light socket to the base.

The method may further include fixing a second arm to the backplate nearer the second end of the backplate; fixing second light socket to the second arm; and running a second electrical conductor from the second light socket to the base.

The method may further include fixing a pedestal member to the base; and wherein the first end of the backplate is fixed to the base through the pedestal member, so that the backplate is offset horizontally from the base.

The method may include attaching a first lamp shade to the first arm; and attaching a second lamp shaded to the second arm.

The method may further include fixing a first switch for turning electrical power on and off to the first light socket to the electrical socket between where the first arm is fixed to the backplate and where the first end of the backplate is fixed to the base; and fixing a second switch for turning electrical power on and off to the second light socket to the electrical socket between where the second arm is fixed to the backplate and where the first end of the backplate is fixed to the base.

DETAILED DESCRIPTION OF THE DRAWINGS

Figure 1:
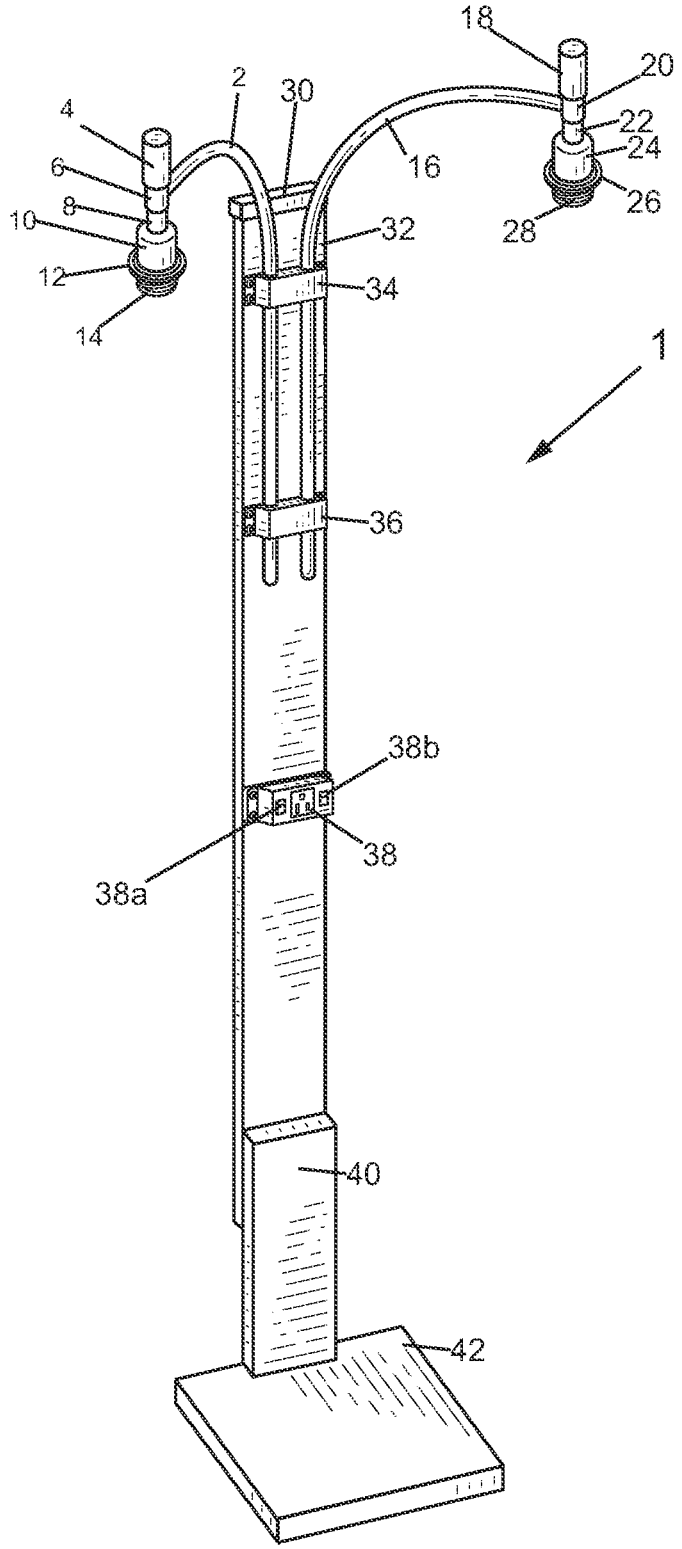
FIG. 1 is a front, left, and top perspective view of a lighting apparatus in accordance with a first embodiment of the present invention.
Figure 2:
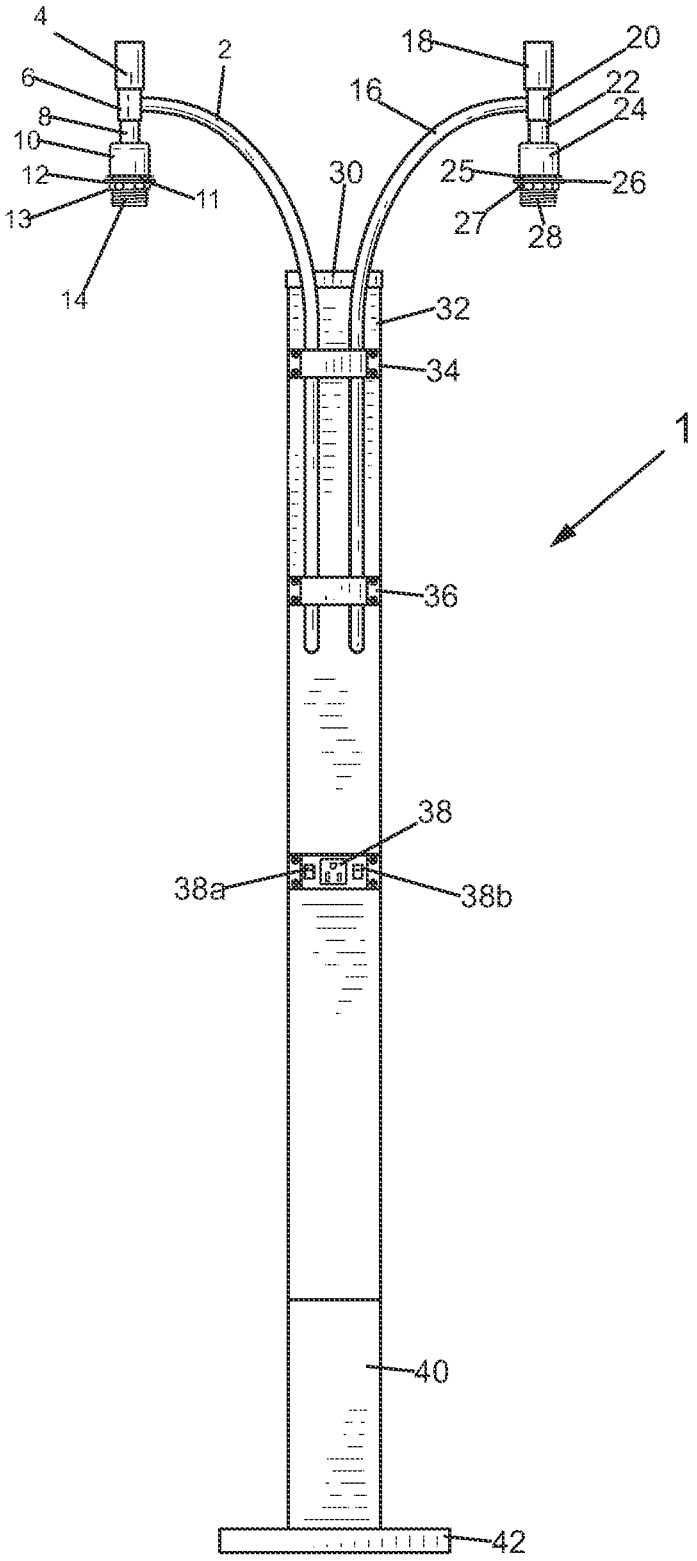
FIG. 2 is a front elevational view of the lighting apparatus of FIG. 1.
Figure 3:
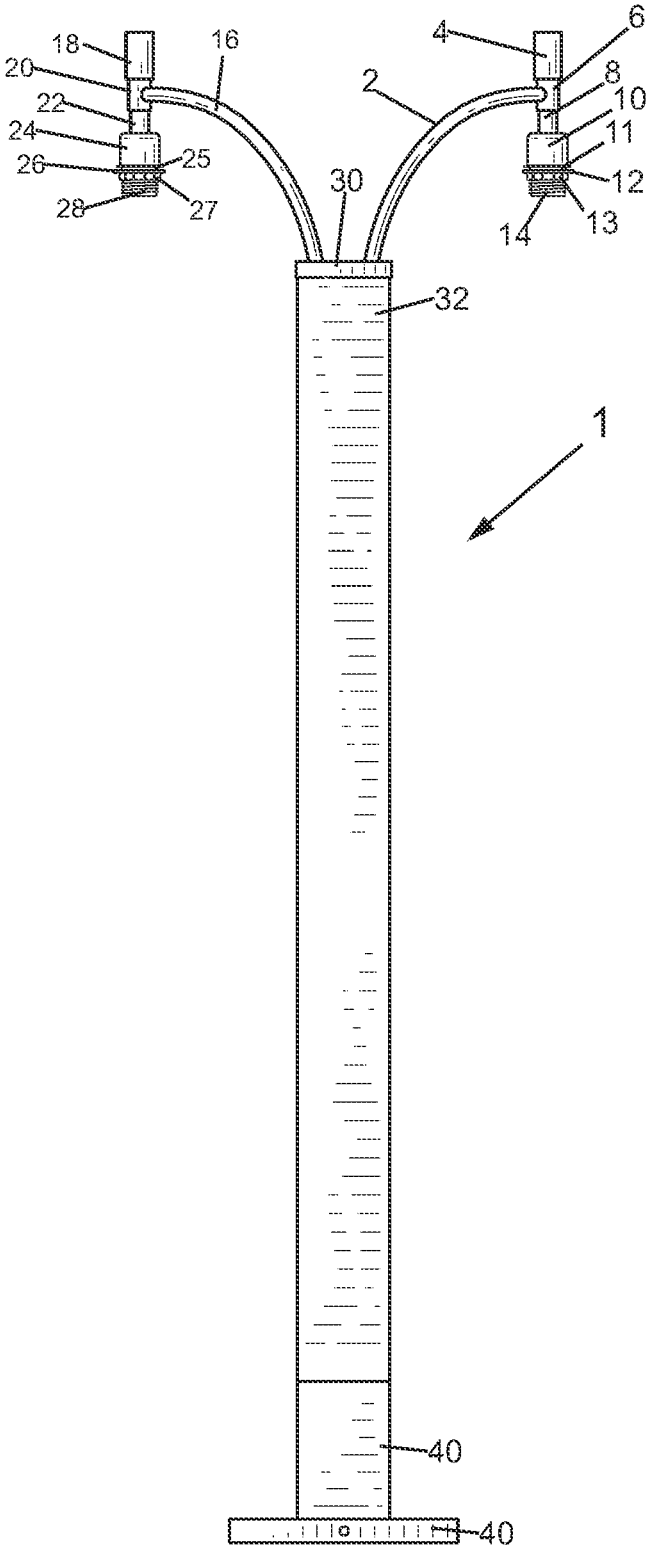
FIG. 3 is a rear elevational view of the lighting apparatus of FIG. 1.
Figure 4:
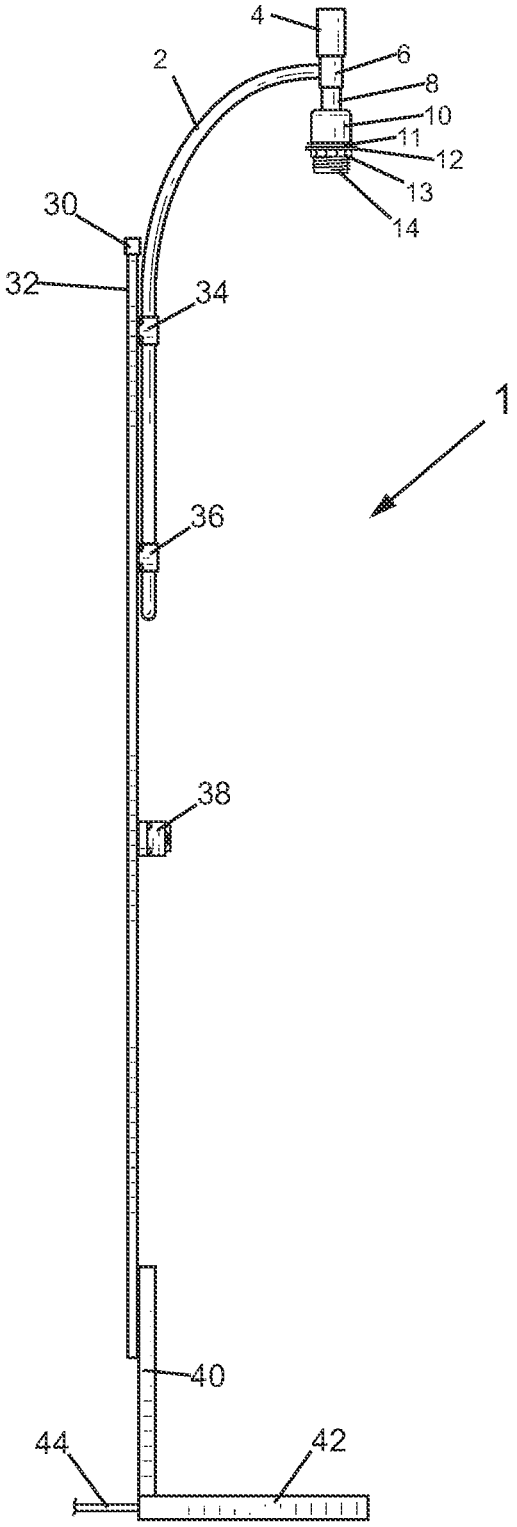
FIG. 4 is a left side elevational view of the lighting apparatus of FIG. 1.
Figure 5:
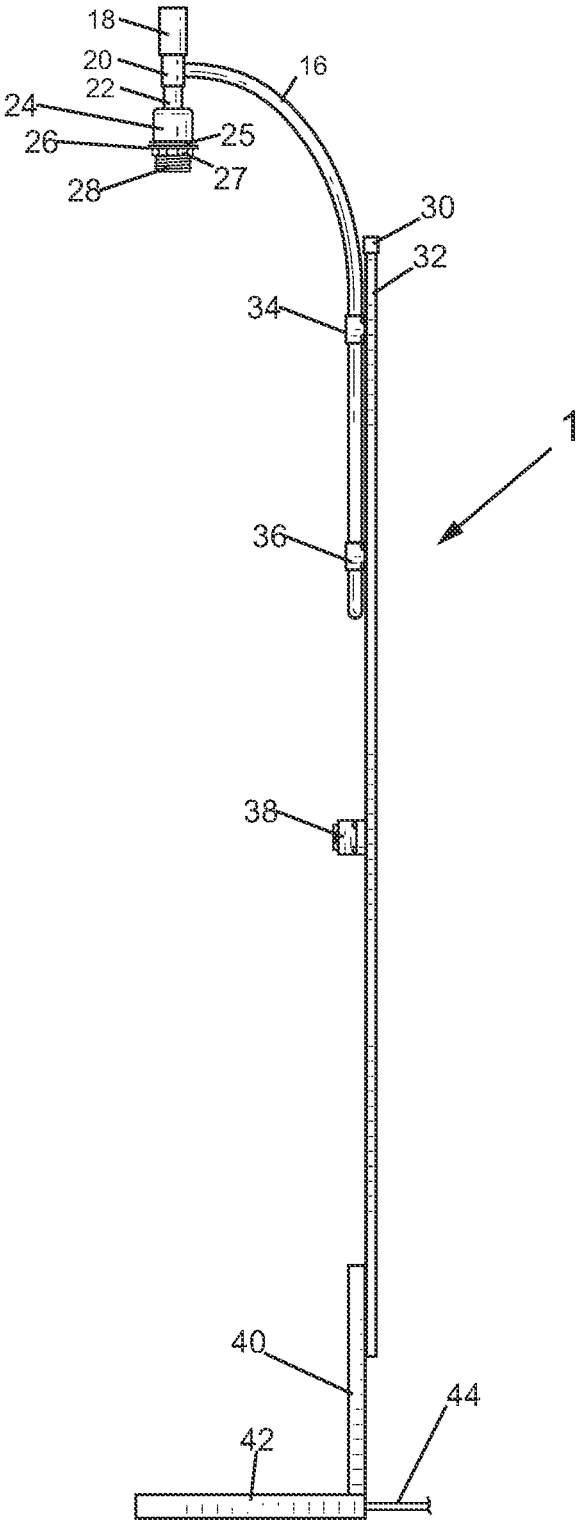
FIG. 5 is a right side elevational view of the lighting apparatus of FIG. 1.
Figure 6:
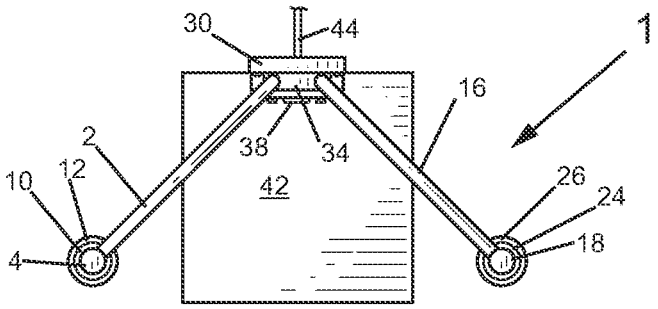
FIG. 6 is a top plan view of the lighting apparatus of FIG. 1.
Figure 7:
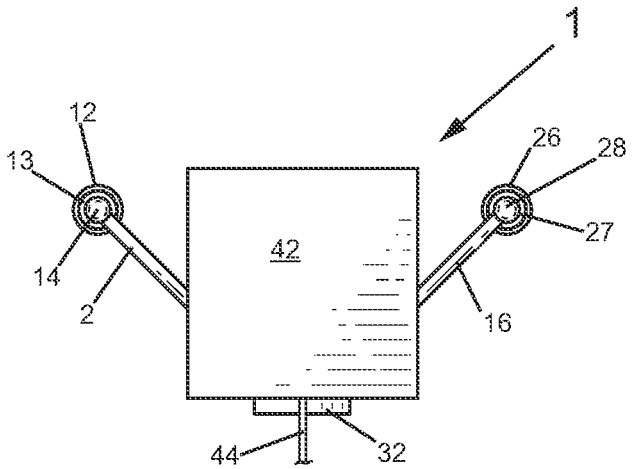
FIG. 7 is a bottom plan view of the lighting apparatus of FIG. 1.
Figure 8:
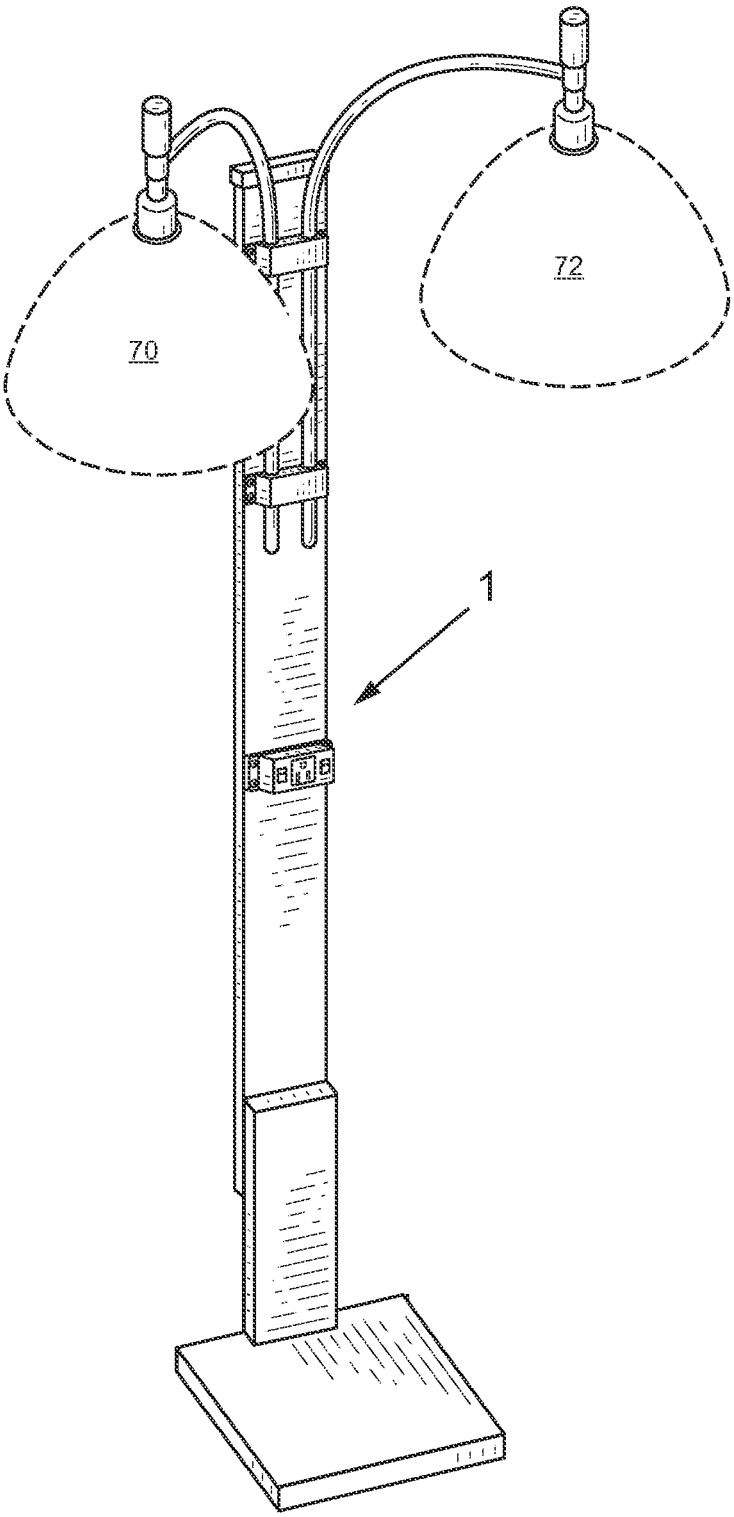
FIG. 8 is a front, left, and top perspective view of the lighting apparatus of FIG. 1 along with two lamps shades, shown in dashed lines.

FIG. 1 is a front, left, and top perspective view of a lighting apparatus 1 in accordance with a first embodiment of the present invention. FIG. 2 is a front elevational view of the lighting apparatus 1 of FIG. 1. FIG. 3 is a rear elevational view of the lighting apparatus 1 of FIG. 1. FIG. 4 is a left side elevational view of the lighting apparatus 1 of FIG. 1. FIG. 5 is a right side elevational view of the lighting apparatus 1 of FIG. 1. FIG. 6 is a top plan view of the lighting apparatus 1 of FIG. 1. FIG. 7 is a bottom plan view of the lighting apparatus 1 of FIG. 1. FIG. 8 is a front, left, and top perspective view of the lighting apparatus 1 of FIG. 1 along with lamp shade 70 and lamp shade 72 shown in dashed lines.

Referring to FIGS. 1-7, and particularly FIG. 2, the lighting apparatus 1 includes an arm 2, a member or decorative finial 4, a member or sleeve 6, a member or sleeve 8, a member or socket cover 10, a member 11, a member 12, a member or threaded nut 13, and a member or threaded socket 14. The threaded socket 14 may be configured to receive a known light bulb. The threaded nut 13 may be configured so that lamp shade, such as lamp shade 70 shown in FIG. 8, can be attached to the members 11 and 12, such as by threaded nut or connector 13, shown in FIG. 2, while the known light bulb, not shown, is connected to the threaded socket 14. Inside the members 14, 13, 12, 11, 10, 8, 6, and arm 2 may be electrical wires or electrical conductors, which electrically connect to a light bulb held by member or threaded socket 14.

The lighting apparatus 1 further includes member or decorative cover 30, member or backplate 32, attachment device or harness 34, attachment device or harness 36, electrical socket or convenience outlet 38, and electrical switches 38*a* and 38*b*, member or pedestal 40, base 42, and electrical cord 44 shown partially in FIG. 4. When an electrical plug, not shown, which is connected to electrical cord 44, is plugged into an electrical outlet, such as a house electrical outlet or socket, electricity is provided from the electrical house outlet, through the cord 44 up through an electrical conductor inside of member 40, up through an electrical conductor inside of member or backplate 32, then into arm 2, then into member of sleeve 6, then member or sleeve 8 then member or socket cover 10, through members 11, 12, and 13 shown in FIG. 4, and then into an electrical light bulb, not shown which is held by threaded socket 14.

The lighting apparatus 1 further includes arm 16, member or decorative finial 18, member or sleeve 20, member or sleeve 22, member or socket cover 24, member 25, member 26, member or threaded nut 27, and member or threaded socket 28 shown in FIG. 5.

The threaded nut 27, shown in FIG. 2, may be configured so that lamp shade, such as lamp shade 72 shown in FIG. 8, can be attached to the members 25 and 26, such as by threaded nut or member 27 27, shown in FIG. 5, while the known light bulb, not shown, is connected to the member or threaded socket 28. Inside the members 28, 27, 26, 25, 24, 22, 20, and arm 16 may be electrical wires or electrical conductors, which electrically connect to a light bulb held by member or threaded socket 28.

When an electrical plug, not shown, which is connected to electrical cord 44, is plugged into an electrical outlet, such as a house electrical outlet or socket, electricity is provided from the electrical house outlet, through the cord 44 up through an electrical conductor inside of member 40, up through an electrical conductor inside of member or backplate 32, then into arm 16, (simultaneously with electricity into arm 2) then into member or sleeve 20, then member or sleeve 22 then member or socket cover 24, through members 25, 26, and 27 shown in FIG. 5, and then into an electrical light bulb, not shown which is held by member or threaded socket 28.

In addition, electricity provided by the plug, not shown, which is connected to electrical cord 44, and which is connected to a house electrical outlet, also results in electrical power being provided to convenience outlet 38, shown in FIG. 1.

In at least one embodiment, the electrical switch 38*a* turns on and off power to the socket 14 and thereby lights or turns off light to a light bulb held by the socket 14; and the electrical switch 38*b* turns on and off power to the socket 28 and thereby lights or turns off light to a light bulb held by socket 28. In at least one embodiment, electrical power to socket 38 is always on when the electrical plug 44 is connected to a house electrical outlet.

Figure 9:
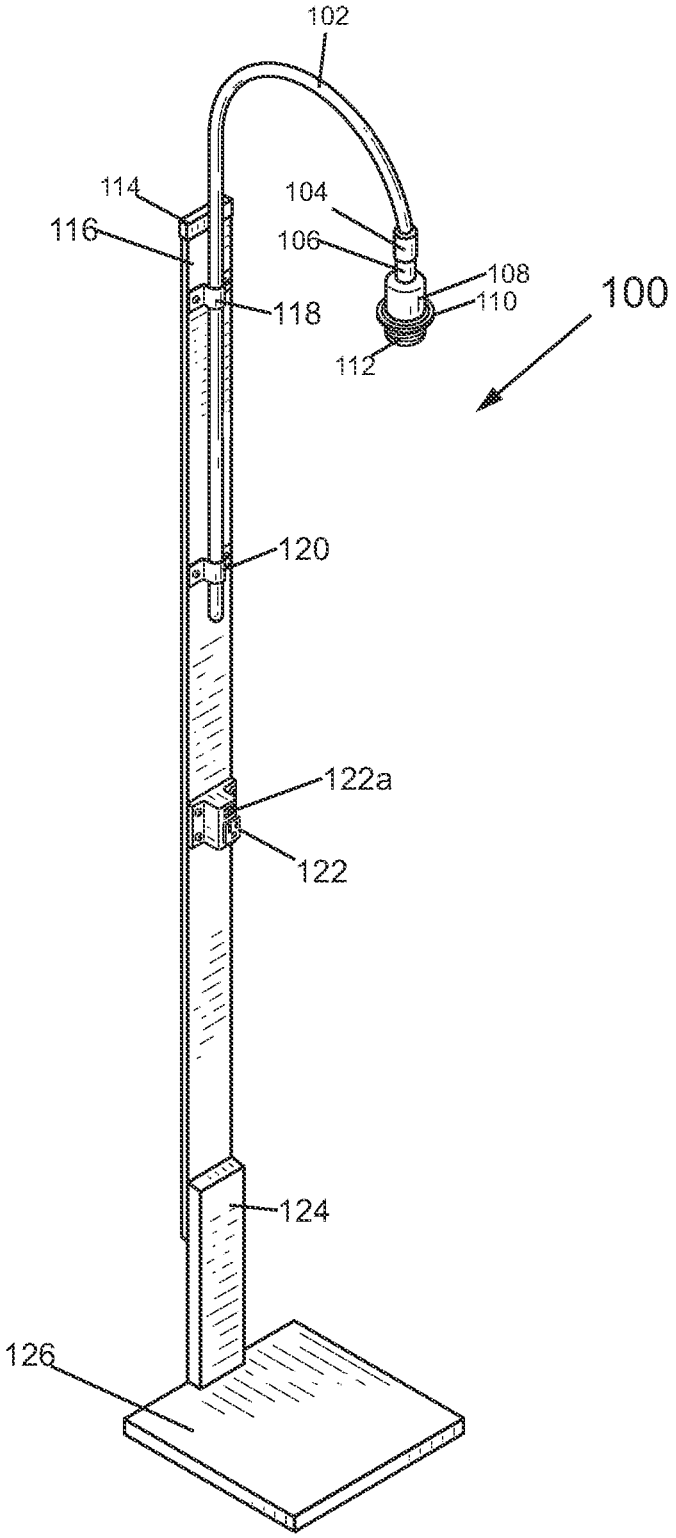
FIG. 9 is a front, left, and top perspective view of a lighting apparatus in accordance with another embodiment of the present invention.
Figure 10:
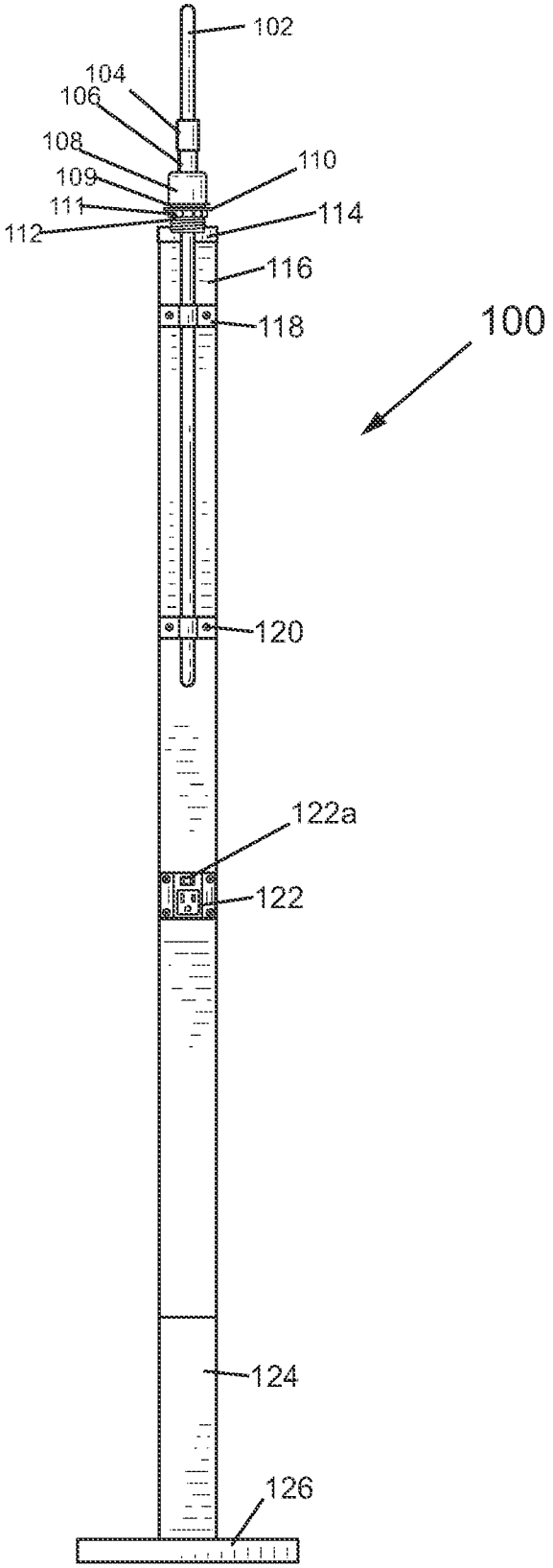
FIG. 10 is a front elevational view of the lighting apparatus of FIG. 9.
Figure 11:
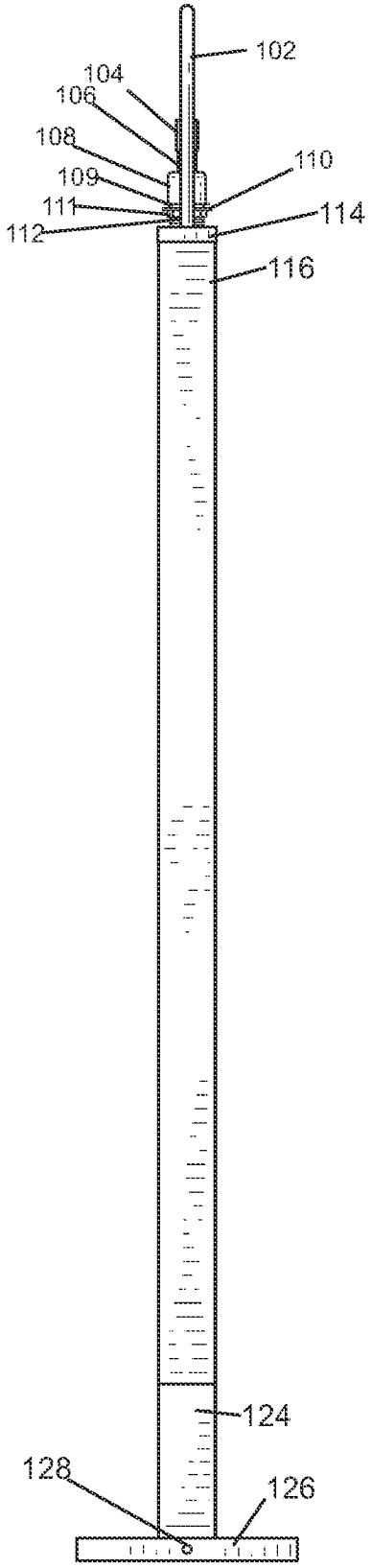
FIG. 11 is a rear elevational view of the lighting apparatus of FIG. 9.
Figure 12:
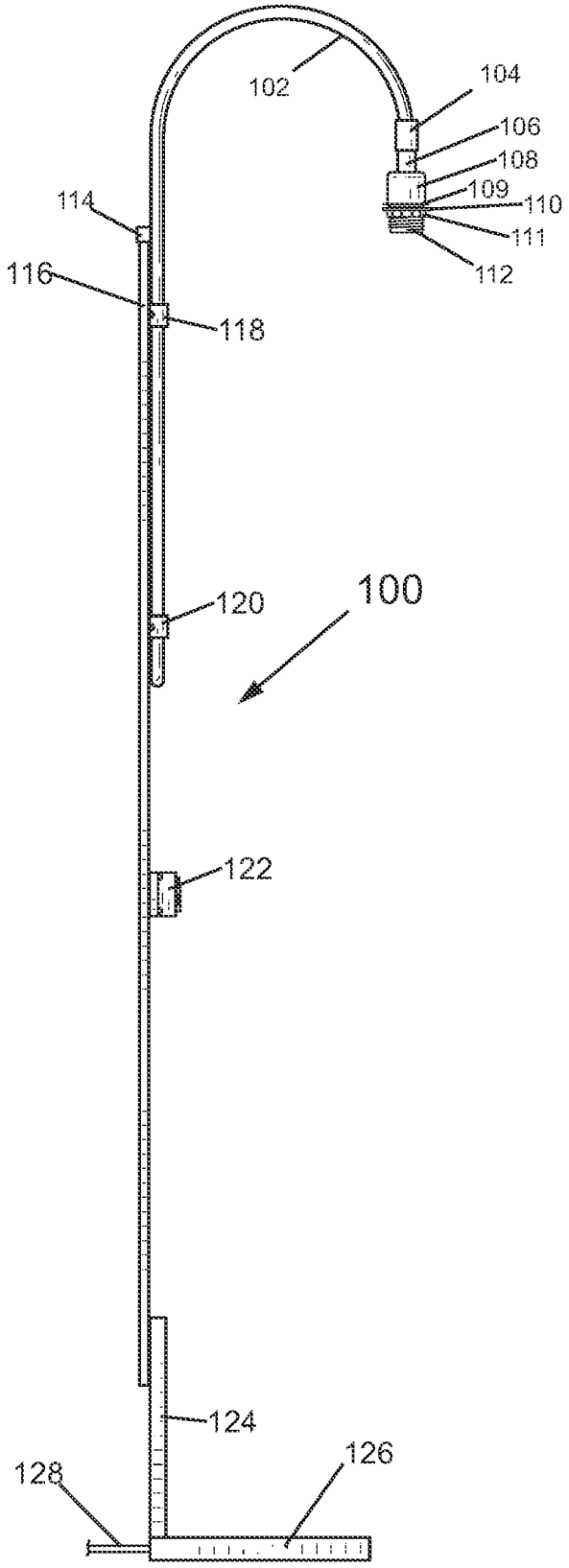
FIG. 12 is a left side elevational view of the lighting apparatus of FIG. 9.
Figure 13:
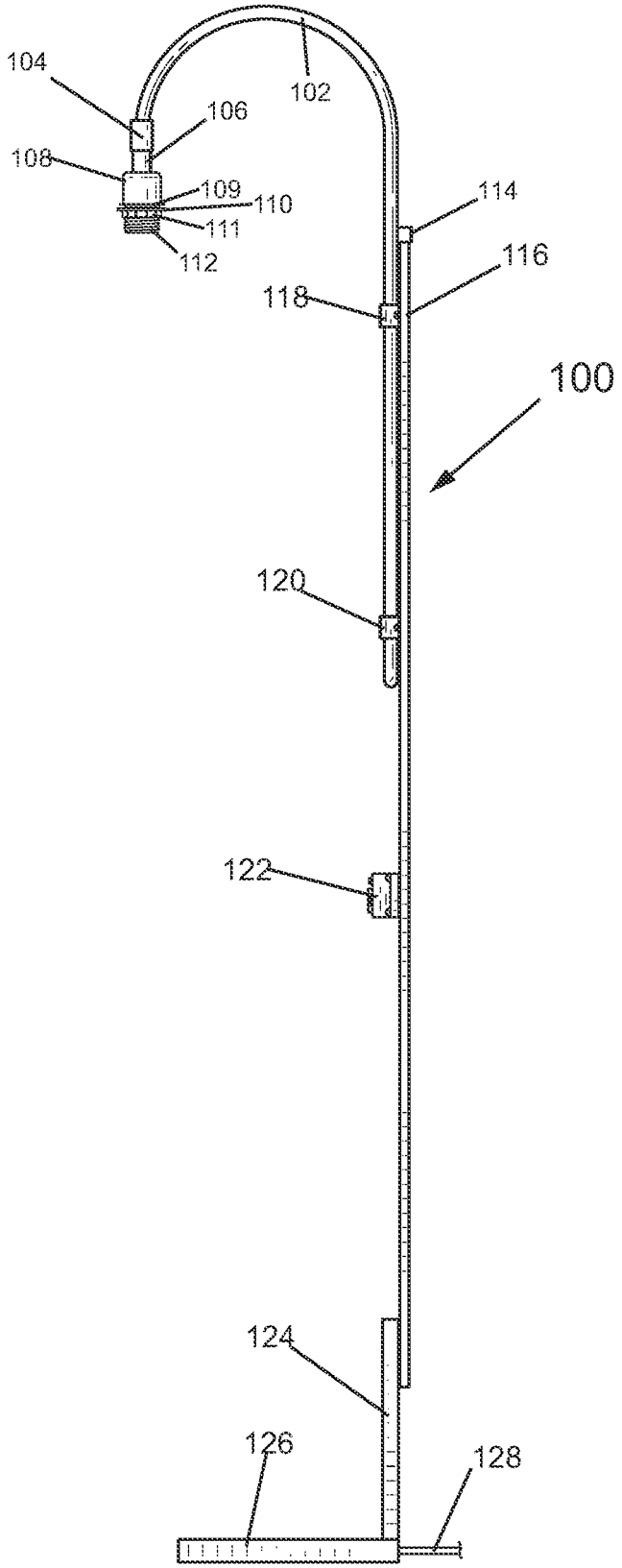
FIG. 13 is a right side elevational view of the lighting apparatus of FIG. 9.
Figure 14:
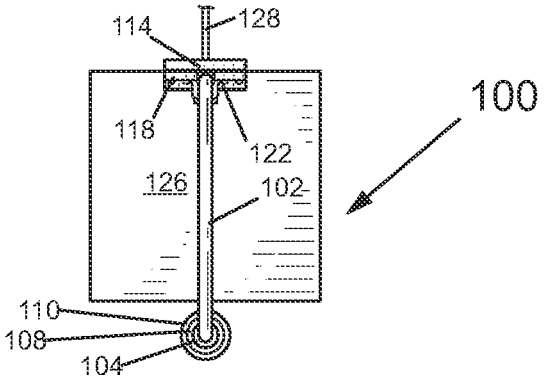
FIG. 14 is a top plan view of the lighting apparatus of FIG. 9.
Figure 15:
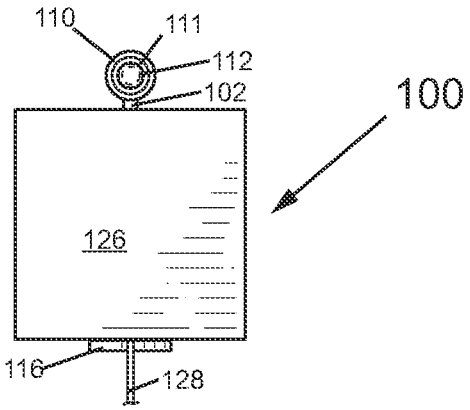
FIG. 15 is a bottom plan view of the lighting apparatus of FIG. 9.
Figure 16:
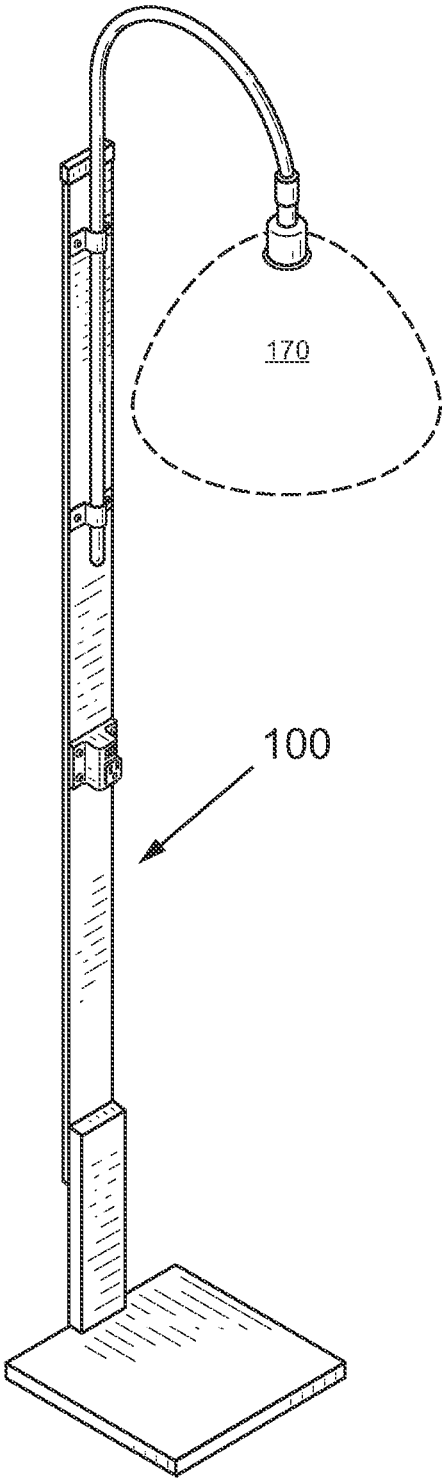
FIG. 16 is a front, left, and top perspective view of the lighting apparatus of FIG. 9 along with one lamp shade, shown in dashed lines.

FIG. 9 is a front, left, and top perspective view of a lighting apparatus 100 in accordance with another embodiment of the present invention. FIG. 10 is a front elevational view of the lighting apparatus 100 of FIG. 9. FIG. 11 is a rear elevational view of the lighting apparatus 100 of FIG. 9. FIG. 12 is a left side elevational view of the lighting apparatus 100 of FIG. 9. FIG. 13 is a right side elevational view of the lighting apparatus 100 of FIG. 9. FIG. 14 is a top plan view of the lighting apparatus 100 of FIG. 9. FIG. 15 is a bottom plan view of the lighting apparatus 100 of FIG. 9. FIG. 16 is a front, left, and top perspective view of the lighting apparatus of FIG. 9 along with one lamp shade shown in dashed lines.

Referring to FIGS. 9-15, particularly FIG. 10, the lighting apparatus 100 includes arm 102, member or sleeve 104, member or sleeve 106, member 109, member or socket cover 108, member 109, member 110, member or threaded nut 111, and member or threaded socket 112. The member or threaded socket 112 may be configured to receive a known light bulb. The members 109 and 110 may be configured so that lamp shade, such as lamp shade 170 shown in FIG. 16, can be attached to the members 109 and 110, such as by threaded nut or connector 111, shown in FIG. 12, while the known light bulb, not shown, is connected to the member or threaded socket 112. Inside the members 112, 111, 110, 109, 108, 106, 104 and arm 102 may be electrical wires or electrical conductors, which electrically connect to a light bulb held by member or threaded socket 112.

The lighting apparatus 100 further includes member or decorative cover 114, member or backplate 116, attachment device or harness 118, attachment device or harness 120, electrical socket or convenience outlet 122, electrical switch 122*a*, member or pedestal 124, base 126, and electrical cord 128 shown partially in FIG. 12. When an electrical plug or prongs, not shown, which is connected to electrical cord 128, is plugged into an electrical outlet, such as a house electrical outlet or socket, electricity is provided from the electrical house outlet, through the cord 128 up through an electrical conductor inside of member 124, up through an electrical conductor inside of member or backplate 116, then into arm 102, then into member 104, then member 106, then through members 108, 109, 110, 111, 112 and into an electrical light bulb, not shown which is held by member or threaded socket 112.

In addition, electricity provided by the plug, not shown, which is connected to electrical cord 128, and which is connected to a house electrical outlet, also results in electrical power being provided to socket or convenience outlet 122, shown in FIG. 12.

In at least one embodiment, the electrical switch 122*a* turns on and off power to the socket 112 and thereby lights or turns off light to a light bulb held by the socket 112. In at least one embodiment, electrical power to socket 122 is always on when the electrical plug 128 (which has prongs, not shown for connecting to an outlet) is connected to a house electrical outlet.

Figure 17:
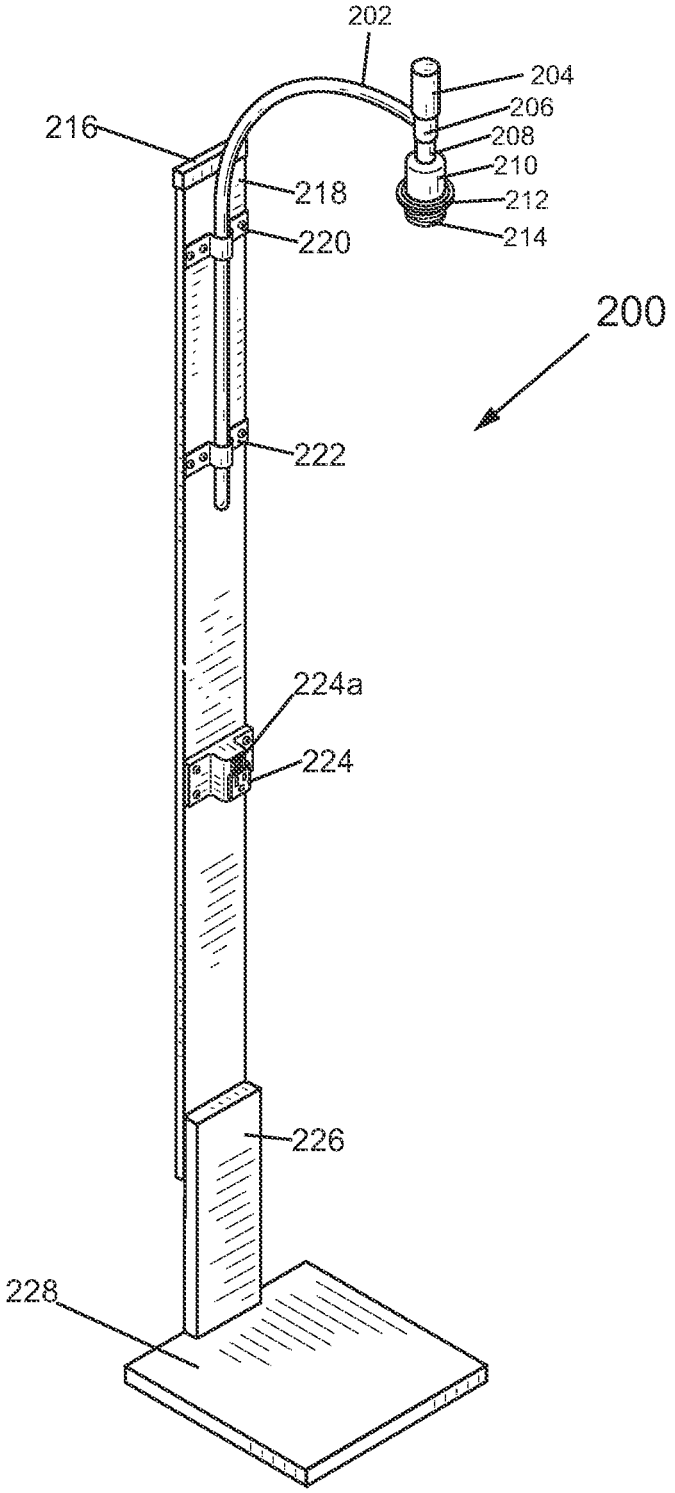
FIG. 17 is a front, left, and top perspective view of a lighting apparatus in accordance with yet another embodiment of the present invention.
Figure 18:
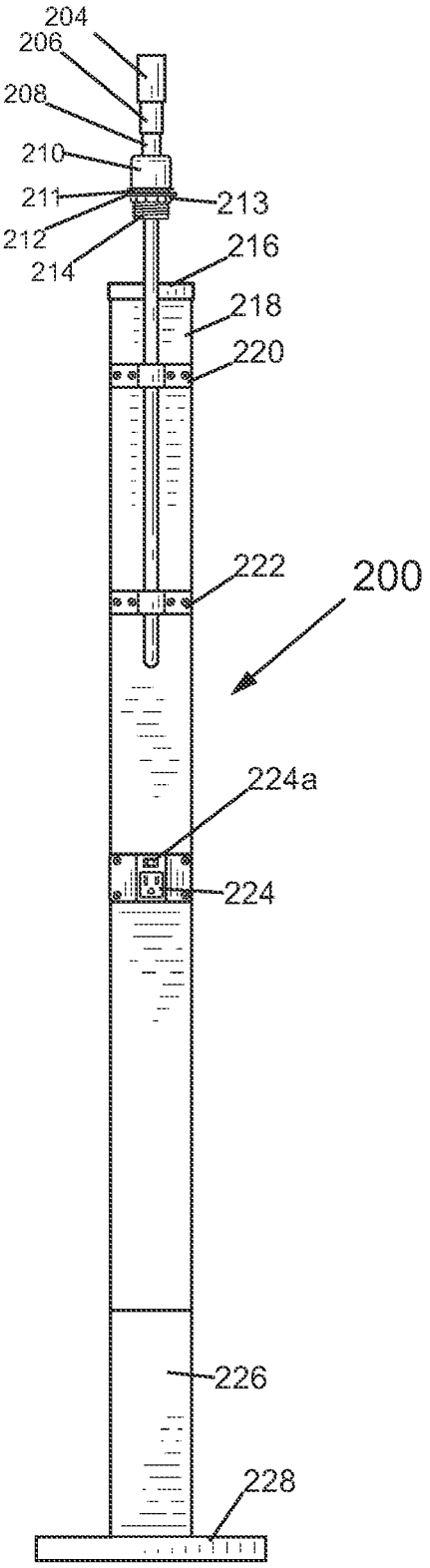
FIG. 18 is a front elevational view of the lighting apparatus of FIG. 17.
Figure 19:
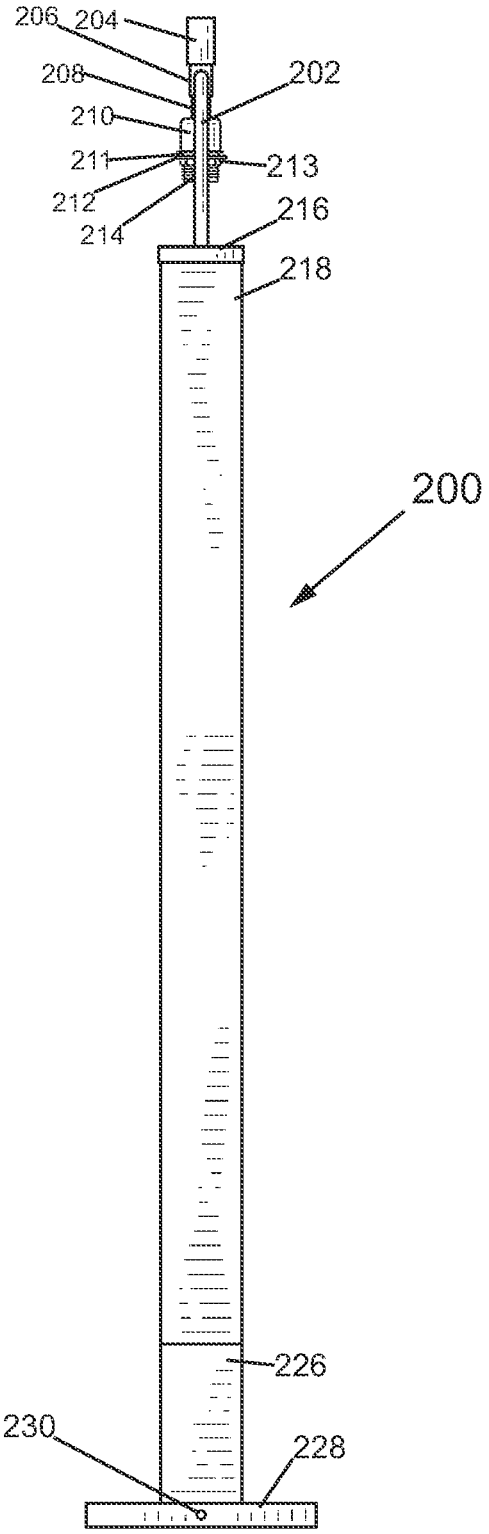
FIG. 19 is a rear elevational view of the lighting apparatus of FIG. 17.
Figure 20:
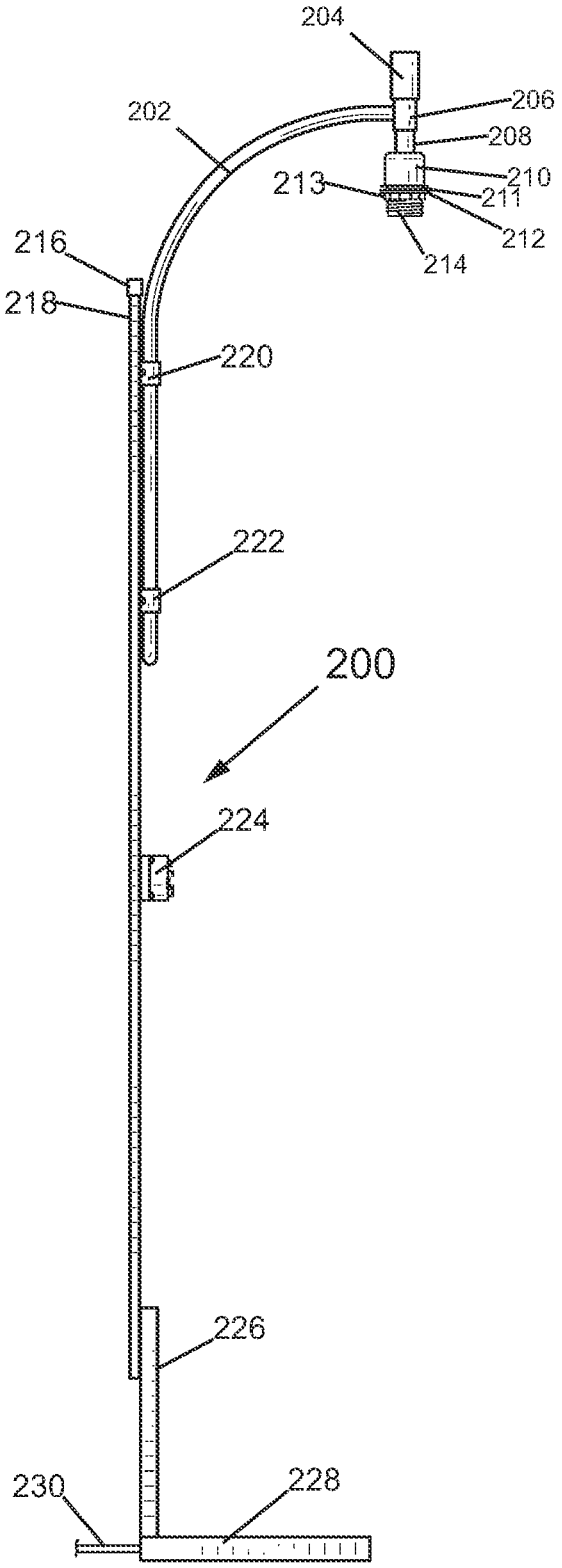
FIG. 20 is a left side elevational view of the lighting apparatus of FIG. 17.
Figure 21:
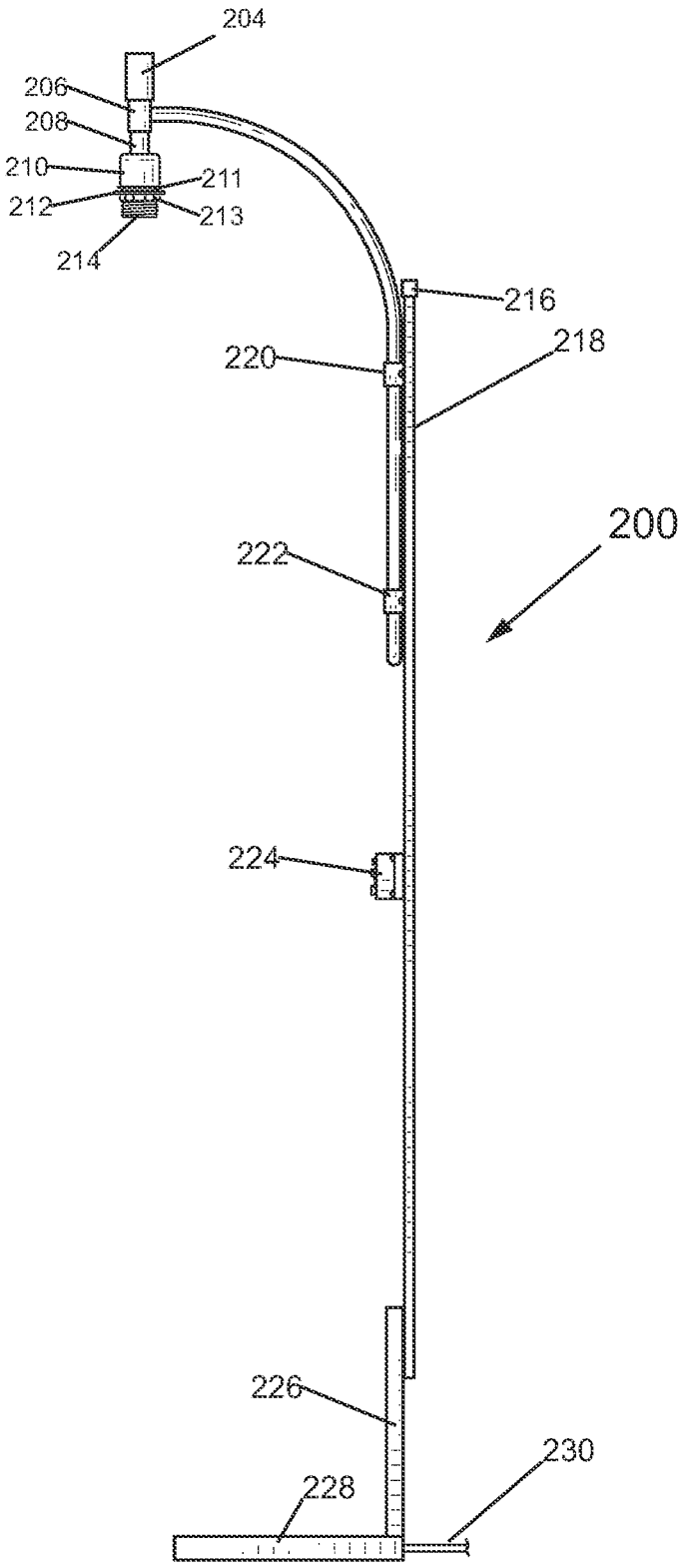
FIG. 21 is a right side elevational view of the lighting apparatus of FIG. 17.
Figure 22:
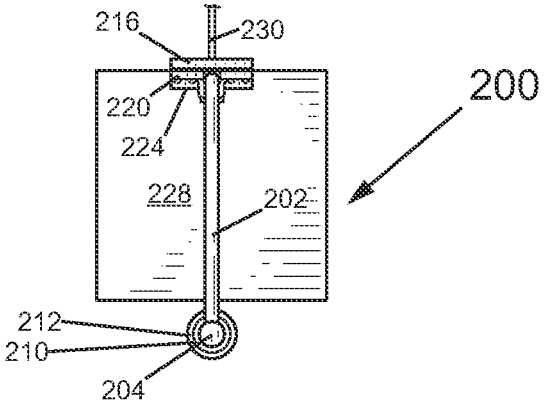
FIG. 22 is a top plan view of the lighting apparatus of FIG. 17.
Figure 23:
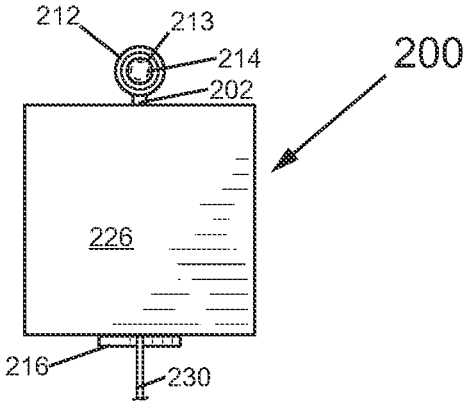
FIG. 23 is a bottom plan view of the lighting apparatus of FIG. 17.
Figure 24:
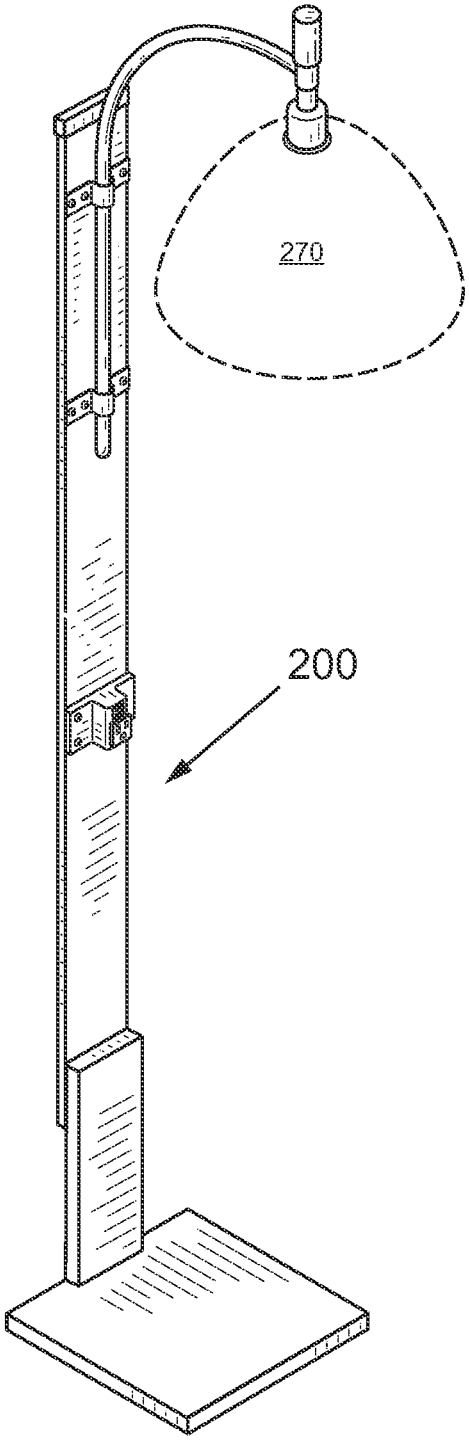
FIG. 24 is a front, left, and top perspective view of the lighting apparatus of FIG. 17 along with one lamps shade, shown in dashed lines.

FIG. 17 is a front, left, and top perspective view of a lighting apparatus 200 in accordance with yet another embodiment of the present invention. FIG. 18 is a front elevational view of the lighting apparatus 200 of FIG. 17. FIG. 19 is a rear elevational view of the lighting apparatus 200 of FIG. 17. FIG. 20 is a left side elevational view of the lighting apparatus 200 of FIG. 17. FIG. 21 is a right side elevational view of the lighting apparatus 200 of FIG. 17. FIG. 22 is a top plan view of the lighting apparatus 200 of FIG. 17. FIG. 23 is a bottom plan view of the lighting apparatus 200 of FIG. 17. FIG. 24 is a front, left, and top perspective view of the lighting apparatus of FIG. 17 along with lamp shade 270, shown in dashed lines.

Referring to FIGS. 17-23, particularly FIG. 18, the lighting apparatus 200 includes arm 202, member or decorative finial 204, a member or sleeve 206, a member or sleeve 208, a member or socket cover 210, member 211, a member 212, member or threaded nut 213, and a member or threaded socket 214. The member or threaded socket 214 may be configured to receive a known light bulb. The member or threaded nut 213 may be configured so that lamp shade, such as lamp shade 270 shown in FIG. 24, can be attached to the members 211 and 212, such as by threaded nut or connector 213, shown in FIG. 20, while the known light bulb, not shown, is connected to the member or threaded socket 214. Inside the members 214, 213, 212, 211, 210, 208, 206 and arm 202 may be electrical wires or electrical conductors, which electrically connect to a light bulb held by member or threaded socket 214.

The lighting apparatus 200 further includes member or decorative cover 216, member or backplate 218, attachment device or harness 220, attachment device or harness 222, electrical socket or convenience outlet 224, electrical switch 224*a*, member or pedestal 226, a base 228, and an electrical cord 230 shown partially in FIG. 12. When an electrical plug, not shown, which is connected to electrical cord 230, is plugged into an electrical outlet, such as a house electrical outlet or socket, electricity is provided from the electrical house outlet, through the cord 230 up through an electrical conductor inside of member 226, up through an electrical conductor inside of member 218, then into arm 202, then into member 206, then through members 208, 210, 211, 212, 213, and 214 into an electrical light bulb, not shown which is held by member or threaded socket 214.

In addition, electricity provided by the plug, not shown, which is connected to electrical cord 230, and which is connected to a house electrical outlet, also results in electrical power being provided to socket or convenience outlet 224, shown in FIG. 20.

In at least one embodiment, the electrical switch 224*a* turns on and off power to the socket 214 and thereby lights or turns off light to a light bulb held by the socket 214. In at least one embodiment, electrical power to socket 224 is always on when an electrical plug (not shown) attached to the electrical cord 128 is connected to a house electrical outlet.

Figure 25:
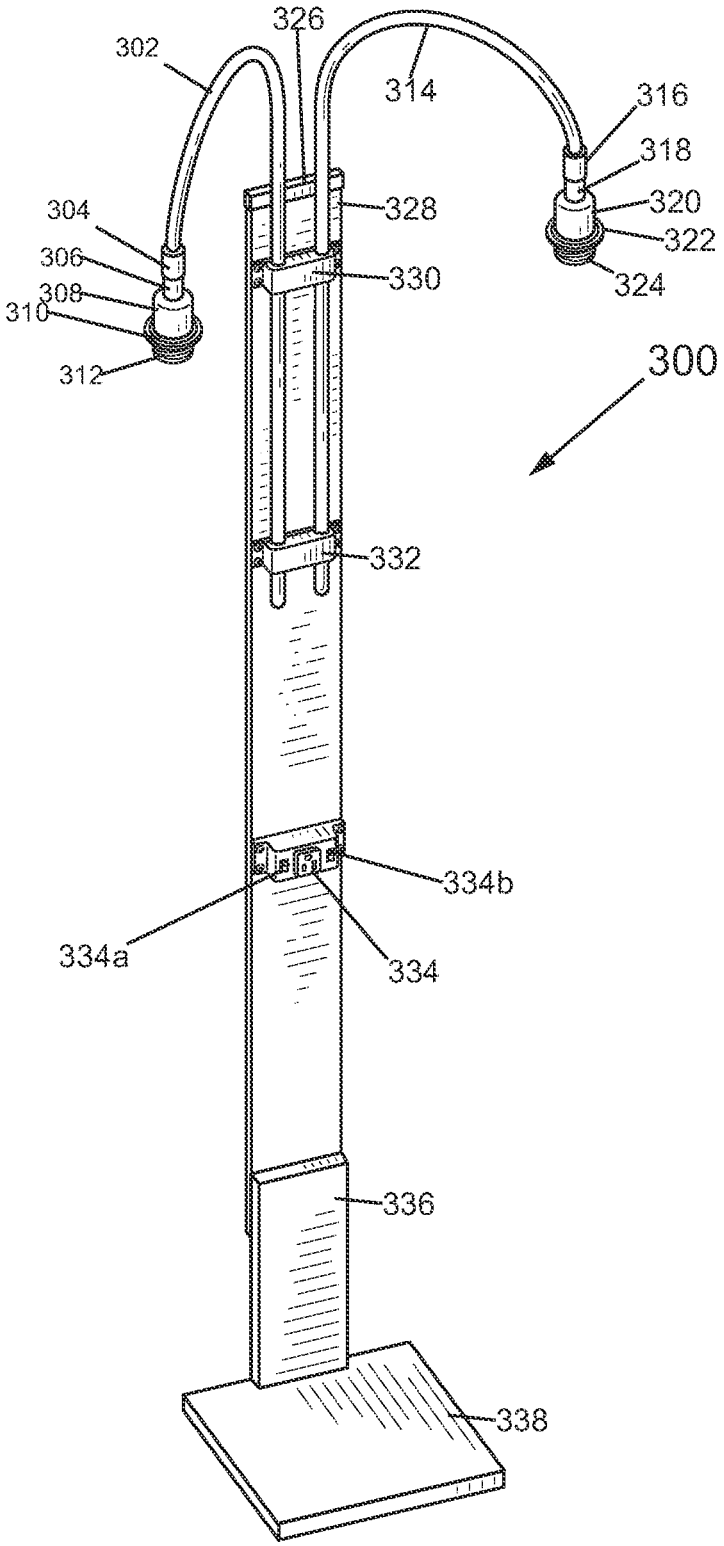
FIG. 25 is a front, left, and top perspective view of a lighting apparatus in accordance with yet another embodiment of the present invention.
Figure 26:
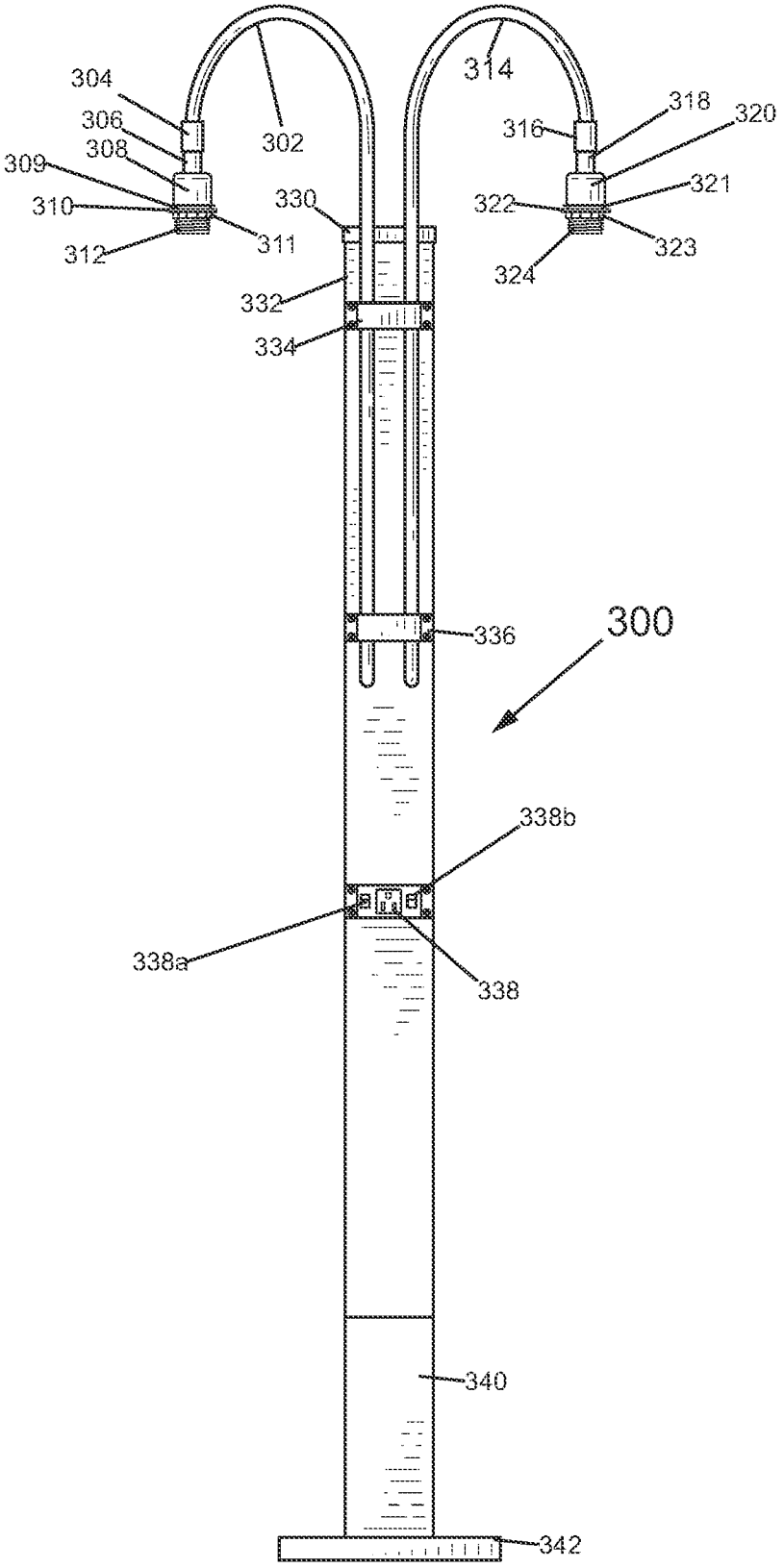
FIG. 26 is a front elevational view of the lighting apparatus of FIG. 25.
Figure 27:
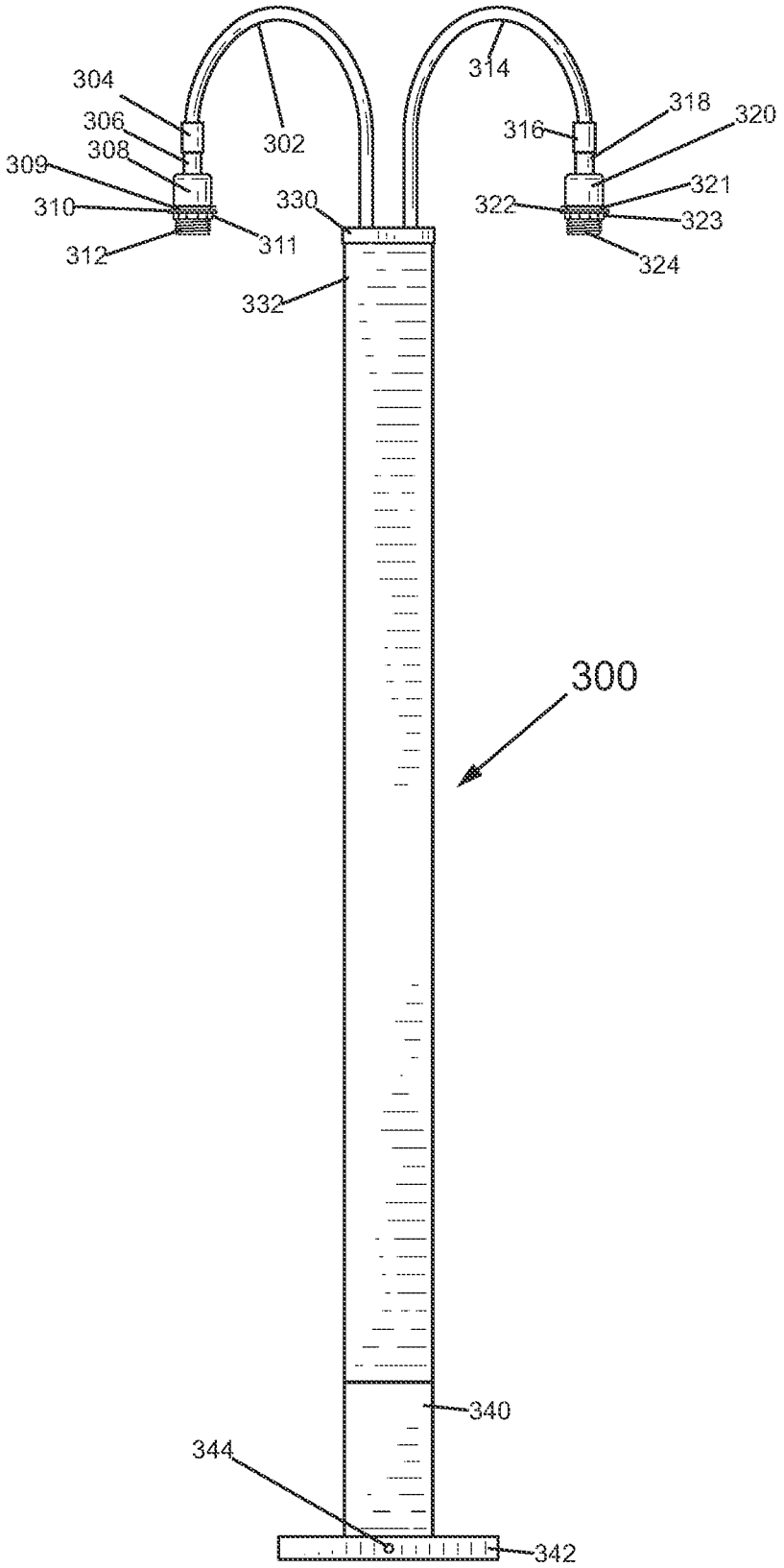
FIG. 27 is a rear elevational view of the lighting apparatus of FIG. 25.
Figure 28:
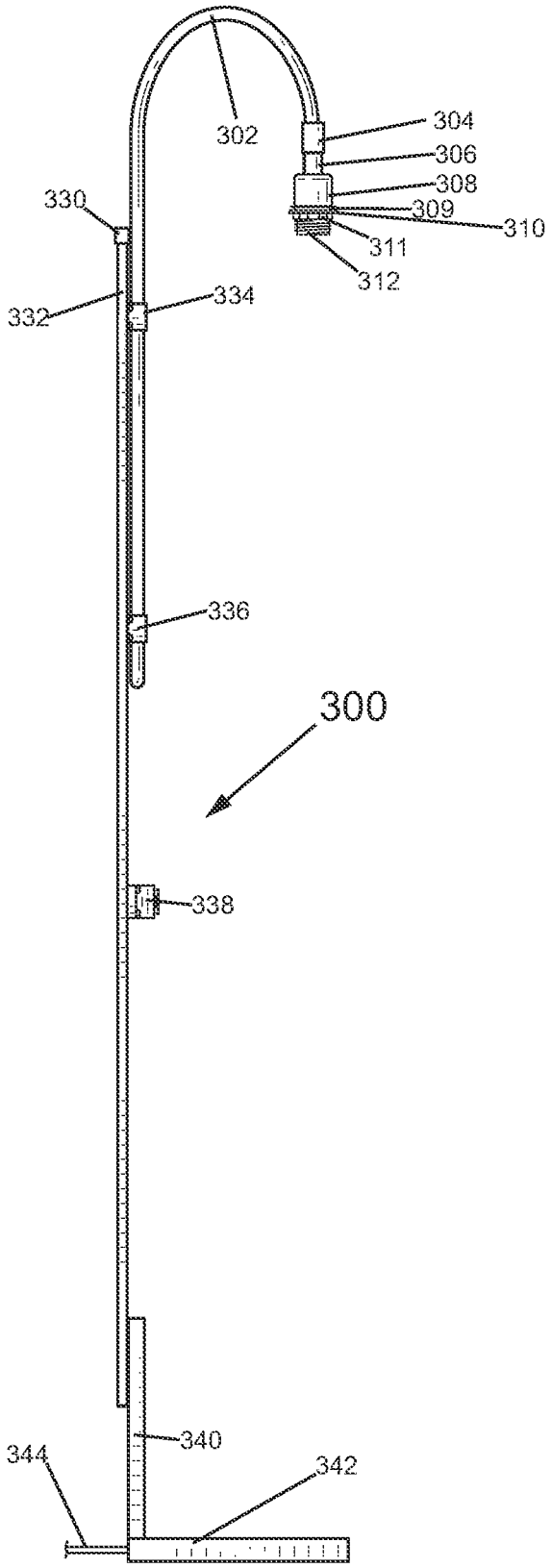
FIG. 28 is a left side elevational view of the lighting apparatus of FIG. 25.
Figure 29:
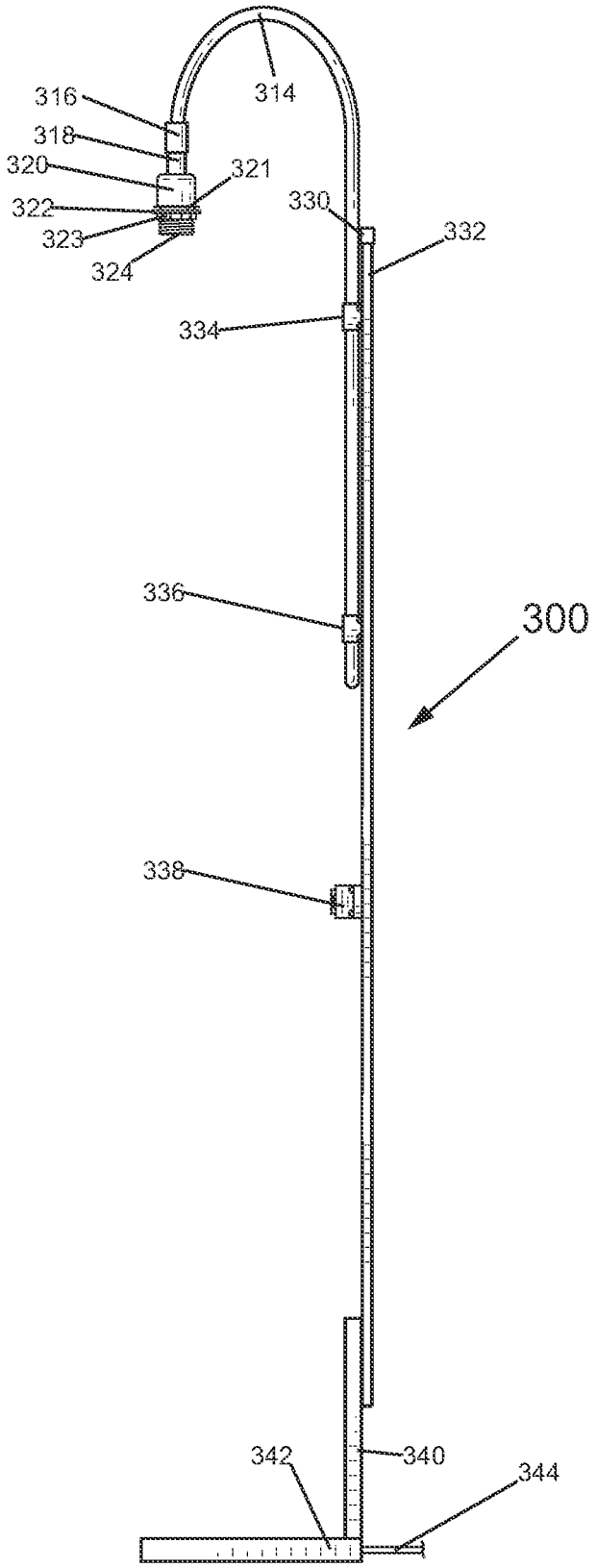
FIG. 29 is a right side elevational view of the lighting apparatus of FIG. 25.
Figure 30:
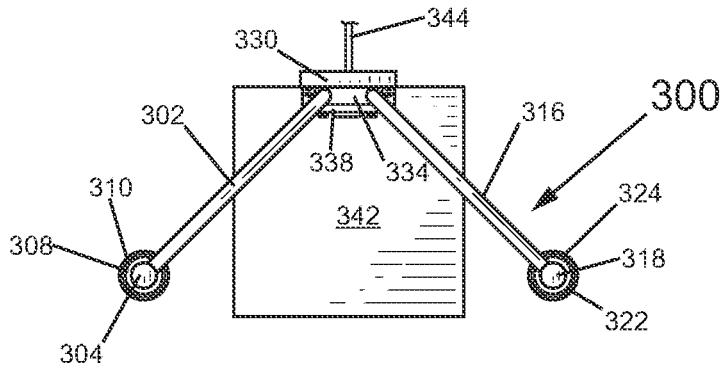
FIG. 30 is a top plan view of the lighting apparatus of FIG. 25.
Figure 31:
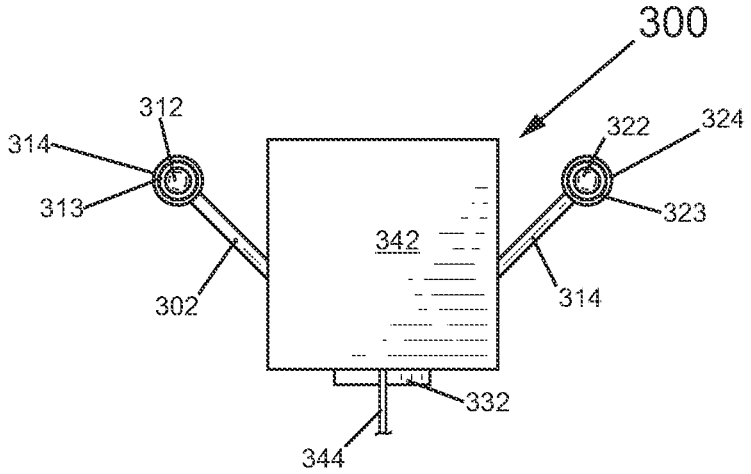
FIG. 31 is a bottom plan view of the lighting apparatus of FIG. 25.
Figure 32:
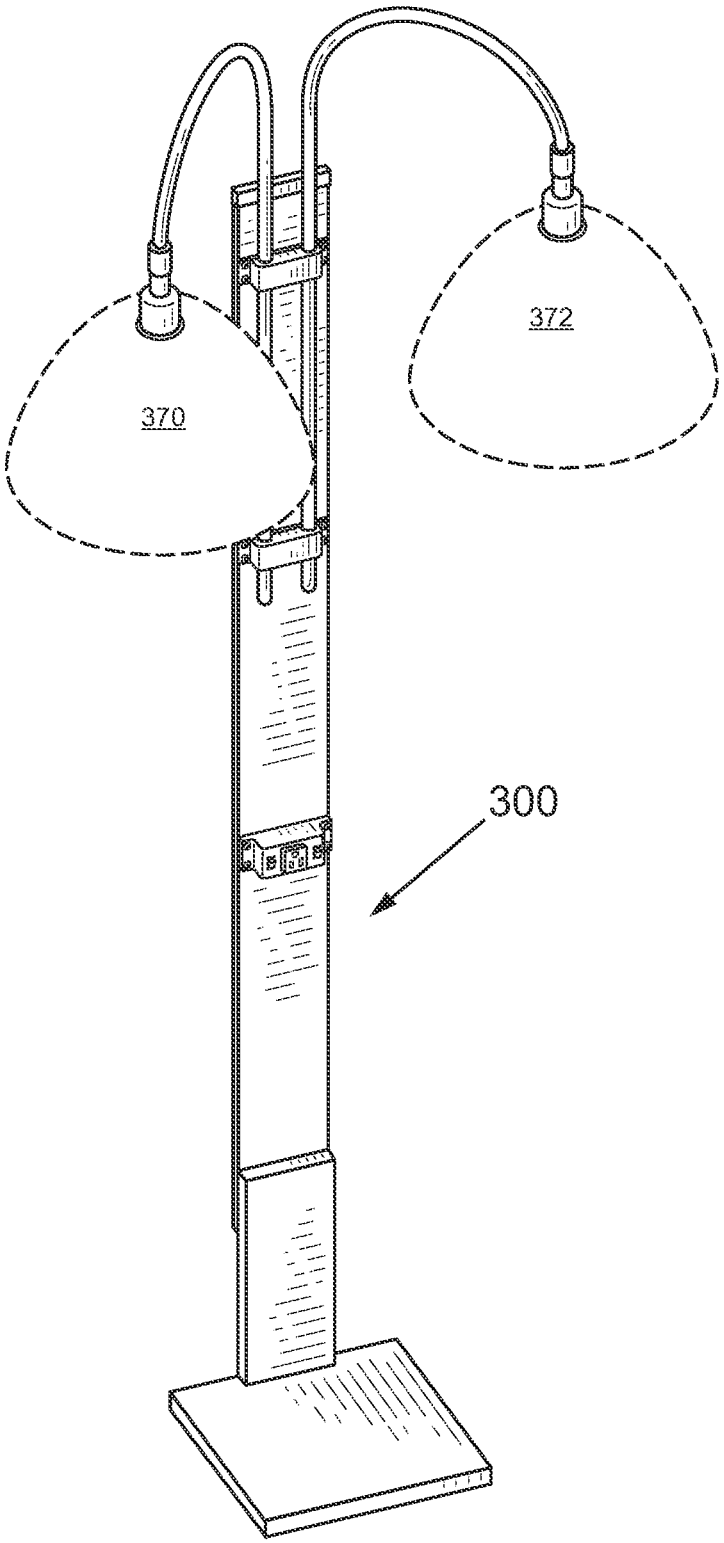
FIG. 32 is a front, left, and top perspective view of the lighting apparatus of FIG. 25 along with two lamps shades, shown in dashed lines.

FIG. 25 is a front, left, and top perspective view of a lighting apparatus 300 in accordance with yet another embodiment of the present invention. FIG. 26 is a front elevational view of the lighting apparatus 300 of FIG. 25. FIG. 27 is a rear elevational view of the lighting apparatus 300 of FIG. 25. FIG. 28 is a left side elevational view of the lighting apparatus 300 of FIG. 25. FIG. 29 is a right side elevational view of the lighting apparatus 300 of FIG. 25. FIG. 30 is a top plan view of the lighting apparatus 300 of FIG. 25. FIG. 31 is a bottom plan view of the lighting apparatus 300 of FIG. 25. FIG. 32 is a front, left, and top perspective view of the lighting apparatus 300 of FIG. 25 along with lamp shade 370 and 372 shown in dashed lines.

Referring to FIGS. 25-31, particularly FIG. 26, the lighting apparatus 300 includes arm 302, member or decorative finial 304, member or sleeve 306, socket cover 308, member 309, member member 310, member or threaded nut 311, and member or threaded socket 312. The member or threaded socket 312 may be configured to receive and hold a known light bulb. The member or socket cover 308, and members 309 and 310 may be configured so that lamp shade, such as lamp shade 370 shown in FIG. 32, can be attached to the member or socket cover 308 and members 309 and 310, such as by threaded nut or connector 311, shown in FIG. 26, while the known light bulb, not shown, is connected to the member or threaded socket 312. Inside the members 312, 311, 310, 309, 308, 306, 304, and arm 302 may be electrical wires or electrical conductors, which electrically connect to a light bulb held by member or threaded socket 312.

The lighting apparatus 300 further includes member or decorative cover 330, member or backplate 332, attachment device or harness 334, attachment device or harness 336, electrical socket or convenience outlet and switch 338, member or pedestal 340, base 342, and electrical cord 344 shown partially in FIG. 28. When an electrical plug, not shown, which is connected to electrical cord 344, is plugged into an electrical outlet, such as a house electrical outlet or socket, electricity is provided from the electrical house outlet, through the cord 344 up through an electrical conductor inside of member 340, up through an electrical conductor inside of member or backplate 332, then into arm 302, then into member 304, 306, then through members 308, 309, 310, 311, and 312, shown in FIG. 28, and then into an electrical light bulb, not shown which is held by member or threaded socket 312.

The lighting apparatus 300 further includes arm 314, member or sleeve 316, member or sleeve 318, member or socket cover 320, member 321, member 322, member or member or threaded nut 323, and member or threaded socket 324, shown in FIG. 29.

The member or threaded socket 324 may be configured so that lamp shade, such as lamp shade 372 shown in FIG. 32, can be attached to the member or threaded socket 324, such as by nut or connector 323, shown in FIG. 29, while the known light bulb, not shown, is connected to the member or threaded socket 324. Inside the members 324, 323, 322, 321, 320, 318, 316, and arm 314 may be electrical wires or electrical conductors, which electrically connect to a light bulb held by member or threaded socket 324.

When an electrical plug, not shown, which is connected to electrical cord 344, is plugged into an electrical outlet, such as a house electrical outlet or socket, electricity is provided from the electrical house outlet, through the cord 344 up through an electrical conductor inside of member 340, up through an electrical conductor inside of member or backplate 332, then into arm 314, (simultaneously with electricity into arm 302) then into member 316, then through members 318, 320, 321, 322, 323, and 324, then into an electrical light bulb, not shown which is held by member or threaded socket 324.

In addition, electricity provided by the plug, not shown, which is connected to electrical cord 344, and which is connected to a house electrical outlet, also results in electrical power being provided to socket 338, shown in FIG. 29.

In at least one embodiment, the electrical switch 338*a* turns on and off power to the socket 312 and thereby lights or turns off light to a light bulb held by the socket 312. In at least one embodiment, electrical power to socket 338 is always on when an electrical plug (not shown) attached to the electrical cord 344 is connected to a house electrical outlet.

One or more embodiments of the present invention provide a lighting apparatus, such as one of lighting apparatuses 1, 100, 200, and 300, which frees a nightstand surface substantially or completely compared to table style lamps. Compared to wall sconces, a lighting apparatus, such as one of 1, 100, 200, and 300, in accordance with one or more embodiments of the present invention eliminates the need for an electrician to install power in the wall at precise locations and a finisher from having to finish the junction box/wall. One or more embodiments of the present invention create the appearance of a wall sconce with the ease of a simple plug-in lamp and fits neatly behind a nightstand, with an offset for a floor base, and allows ease of installation and relocation at will.

In at least one embodiment, the backplates 32, 116, 218, and 328 are placed against a wall of a room, but typically not mounted to the wall of the room, while the bases 42, 126, 228, and 338, respectively, sit on a top surface of a table, such as a nightstand table. Each of back plates 32, 116, 218, and 328 may have a thickness of one half inch, which is parallel or substantially parallel to a top surface of the bases 42, 126, 228, and 338, respectively.

The thickness of the backplates 32, 116, 218, and 328 can vary to accommodate heavier/larger shades.

In at least one embodiment, the pedestals or members 40, 124, 226, and 336, are used to provide a horizontal offset of the back plates 32, 116, 218, and 328 from the bases 42, 126, 228, and 338, respectively, to help balance and keep upright the overall lamp apparatuses 1, 100, 200, and 300, with attached shades, in the orientation as shown in FIGS. 8, 16, 24, and 32. The horizontal offsets provides by the pedestals or members 40, 124, 226, and 336, also allow better access to the electrical cords 44, 128, 230, and 344, and help to inhibit the cords 44, 128, 230, and 344, respectively, from being crushed or crimped and allows cords 44, 128, 230, and 344 to go behind bases 42, 126, 228, and 338 and below the back plates 32, 116, 218, and 328, respectively, and to thereby be attached to a house or building electrical outlet, through a plug not shown.

In at least one embodiment, the base, such as any of bases 42, 126, 228, and 338 should be weighted so that the apparatuses 1, 100, 200, and 300 stands upright, without falling down, as shown in FIGS. 1, 9, 17, and 25, respectively, when any of bases 42, 126, 228 and 338 are sitting on a flat desk so that the largest square top surface any of bases 42, 126, 228, 338 is parallel to and lying on the flat desk, which is parallel to a ground surface. The weighted bases 42, 126, 228, and 338 may be made of a heavy metal or of marble to help keep the apparatuses 1, 100, 200, and 300, respectively, upright.

Any of the other members, such as members 2, 4, 6, 8, 10, 11, 12, 13 14, 16, 18, 20, 22, 24, 25, 26, 27, 28, 30, 32, 34, 36, and 40, for apparatus 100 (or similar or identical members shown for apparatuses 100, 200, and 300) may be made of metal or other suitable materials, such as met that is finished with electromagnetic plating or hand-painting.

The sockets 38, 122, 224, and 334 may be made of plastic or porcelain.

The harnesses 34 and 36 may fix the arms 2 and 16 to the member 32 by use of screws or other fasteners or by glue, for example, for apparatus 1, and for similar or identical components for apparatuses 100, 200, and 300. The socket 38 (along with switches 38*a* and 38*b* may be fixed to the member 32 by screws or fasteners or by glue, for example, and for similar or identical components for apparatuses 100, 200, and 300. The member 40 may be fixed to the member 32 by adhesive or in any other known manner; the use of both members 40 and 32 provides an offset from the base 42 which is preferred for apparatus 1, and for similar or identical components for apparatuses 100, 200, and 300.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A lighting apparatus comprising:

a base;

a backplate having a first end fixed to the base, so that the backplate is substantially perpendicular to the base;

a first arm fixed to the backplate nearer a second end of the backplate which is opposite the first end of the backplate;

a first light socket fixed to the first arm;

an electrical socket fixed to the backplate between where the first arm is fixed to the backplate and where the first end of the backplate is fixed to the base; and a first electrical conductor running from the first light socket to the base; and further comprising a second arm fixed to the backplate nearer the second end of the backplate;

a second light socket fixed to the second arm; and a second electrical conductor running from the second light socket to the base; and further comprising a second arm fixed to the backplate nearer the second end of the backplate;

a second light socket fixed to the second arm; and a second electrical conductor running from the second light socket to the base.

2. A lighting apparatus comprising:

a base;

a backplate having a first end fixed to the base, so that the backplate is substantially perpendicular to the base;

a first arm fixed to the backplate nearer a second end of the backplate which is opposite the first end of the backplate;

a first light socket fixed to the first arm;

an electrical socket fixed to the backplate between where the first arm is fixed to the backplate and where the first end of the backplate is fixed to the base; and a first electrical conductor running from the first light socket to the base;

and further comprising a pedestal member fixed to the base; and wherein the first end of the backplate is fixed to the base through the pedestal member, so that the backplate is offset horizontally from the base.

3. The apparatus of claim 1 further comprising a pedestal member fixed to the base; and wherein the first end of the backplate is fixed to the base through the pedestal member, so that the backplate is offset horizontally from the base.

4. The apparatus of claim 1 further comprising a first attachment device configured to attach a first lamp shade to the first arm.

5. The apparatus of claim 1 further comprising a first attachment device configured to attach a first lamp shade to the first arm; and a second attachment device configured to attach a second lamp shade to the second arm, while the first lamp shade is attached to the first arm.

6. The apparatus of claim 1 further comprising a first switch for turning electrical power on and off to the first light socket fixed to the electrical socket between where the first arm is fixed to the backplate and where the first end of the backplate is fixed to the base.

7. The apparatus of claim 1 further comprising a first switch for turning electrical power on and off to the first light socket fixed to the electrical socket between where the first arm is fixed to the backplate and where the first end of the backplate is fixed to the base; and a second switch for turning electrical power on and off to the second light socket fixed to the electrical socket between where the second arm is fixed to the backplate and where the first end of the backplate is fixed to the base.

8. A method comprising the steps of:

fixing a first end of a backplate to a base, so that the backplate is substantially perpendicular to the base;

fixing a first arm to the backplate nearer a second end of the backplate which is opposite the first end of the backplate;

fixing first light socket to the first arm;

fixing an electrical socket to the backplate between where the first arm is fixed to the backplate and where the first end of the backplate is fixed to the base; and running a first electrical conductor from the first light socket to the base; and further comprising fixing a second arm to the backplate nearer the second end of the backplate;

fixing second light socket to the second arm; and running a second electrical conductor from the second light socket to the base.

9. A method comprising the steps of:

fixing a first end of a backplate to a base, so that the backplate is substantially perpendicular to the base;

fixing a first arm to the backplate nearer a second end of the backplate which is opposite the first end of the backplate;

fixing first light socket to the first arm;

fixing an electrical socket to the backplate between where the first arm is fixed to the backplate and where the first end of the backplate is fixed to the base; and running a first electrical conductor from the first light socket to the base; and further comprising fixing a pedestal member to the base; and wherein the first end of the backplate is fixed to the base through the pedestal member, so that the backplate is offset horizontally from the base; and further comprising fixing a second arm to the backplate nearer the second end of the backplate;

fixing second light socket to the second arm; and running a second electrical conductor from the second light socket to the base.

10. The method of claim 8 further comprising fixing a pedestal member to the base; and wherein the first end of the backplate is fixed to the base through the pedestal member, so that the backplate is offset horizontally from the base.

11. The method of claim 8 further comprising attaching a first lamp shade to the first arm.

12. The method of claim 8 further comprising attaching a first lamp shade to the first arm; and attaching a second lamp shaded to the second arm.

13. The method of claim 8 further comprising fixing a first switch for turning electrical power on and off to the first light socket to the electrical socket between where the first arm is fixed to the backplate and where the first end of the backplate is fixed to the base.

14. The method of claim 8 further comprising fixing a first switch for turning electrical power on and off to the first light socket to the electrical socket between where the first arm is fixed to the backplate and where the first end of the backplate is fixed to the base; and fixing a second switch for turning electrical power on and off to the second light socket to the electrical socket between where the second arm is fixed to the backplate and where the first end of the backplate is fixed to the base.

* * * * *